United States Patent [19]

Taguchi

[11] 4,207,964

[45] Jun. 17, 1980

[54] SOUND ABSORBING AND DIFFUSING UNIT, AN ACOUSTIC SCREEN AND A DECORATIVE SOUND ABSORBING PANEL

[76] Inventor: Kazunori Taguchi, 6-8, Sakanoshita, Kamakura City, Kanagawa Prefecture, Japan

[21] Appl. No.: 953,454

[22] Filed: Oct. 23, 1978

Related U.S. Application Data

[62] Division of Ser. No. 701,016, Jun. 30, 1976, Pat. No. 4,122,915.

[30] Foreign Application Priority Data

Jun. 30, 1975 [JP] Japan ..... 50-81296
Jul. 12, 1975 [JP] Japan ..... 50-96921[U]

[51] Int. Cl.[2] ..... E04B 1/99
[52] U.S. Cl. ..... 181/284; 181/210; 181/286; 428/33
[58] Field of Search ..... 181/284, 285, 286, 293, 181/295, 210, 175; 428/53, 33, 133; 52/144

[56] References Cited

U.S. PATENT DOCUMENTS

| | | | |
|---|---|---|---|
| 1,158,051 | 10/1915 | Hopkinson | 428/53 |
| 2,280,631 | 4/1942 | Coffey | 181/293 |
| 2,324,706 | 7/1943 | Jacobson | 181/285 |
| 2,595,047 | 4/1952 | Beranek | 181/286 |
| 3,077,426 | 2/1963 | Johnston | 181/286 |

*Primary Examiner*—Stephen J. Tomsky
*Attorney, Agent, or Firm*—Armstrong, Nikaido, Marmelstein & Kubovcik

[57] ABSTRACT

The sound absorbing and diffusing unit is provided for assembling an acoustic screen which can be placed or hung in front of a wall inside an acoustic room for improving a sound-effect therein. These units are detachably joined together with each other so that they may be easily separated and assembled again to form an acoustic screen having another shape or construction to adjust or modulate a sound-effect. A sound absorbing porous panel having a desired picture or pattern can be easily hung against a wall. The decorative panel can be reversely hung on the wall to provide another interior ornamentation. Accordingly, an acoustically correct room and a desired ornamentation on a wall inside the acoustic room can be easily obtained and changed without providing a rigid reverberating surface of the room.

2 Claims, 6 Drawing Figures

SOUND ABSORBING AND DIFFUSING UNIT, AN ACOUSTIC SCREEN AND A DECORATIVE SOUND ABSORBING PANEL

CROSS REFERENCE TO RELATED APPLICATION

This application is a divisional application of my previously filed application Ser. No. 701,016 filed on June 30, 1976 now U.S. Pat. No. 4,122,915.

FIELD OF THE INVENTION

This invention relates in general to a sound absorbing and diffusing unit, an acoustic screen assembling from said units, and more particularly to a sound absorbing and diffusing unit, an acoustic screen assembling from said units mounted in a sound-effect studio, an auditory room or a music hall for improving a sound-effect and also decorative porous panels hung on a wall of the auditory room for providing an interior ornamentation therein.

DESCRIPTION OF THE PRIOR ART

There have been various devices designed for improving an acoustic characteristic or a sound-effect in a sound-effect studio, an auditory room or a music hall to obtain an acoustically correct effect. In most cases, it depends on a sound characteristic of the rigid reverberating surfaces such as a ceiling, a floor or walls of a room or building.

The sound is either absorbed into sound absorbing materials or diffused off irregular surfaces or polycylindrical structures to improve a sound-effect. Nevertheless, an acoustical reverberation inside the room can not be fully lessened and said room is unlikely to be able to provide the acoustic comfort needed. In addition, it needs a complicated calculation for the acoustical treatment and also an improvement of a reverberating surface inside an acoustic room.

Accordingly, in order to improve the conventional reverberating surfaces such as a ceiling or a wall of a room or a building, it is necessary to entirely improve these rigid sound reflection surfaces, and its working is considerably difficult and expensive. Even if the reverberating surfaces are improved, it is not easy to make further change or modification for modulating and adjusting a sound-effect, where necessary.

The principal object of this invention is to provide a sound absorbing and diffusing unit for detachably assembling an acoustic screen which can be easily placed in front of the rigid reverberating surfaces such as a ceiling, a floor or walls in a sound-effect studio, an auditory room or a music hall for improving a sound-effect thereof.

Another object of this invention is to provide a sound absorbing and diffusing unit for assembling an acoustic screen whereby a sound-effect can be easily adjusted or modulated without improving any area of the rigid reverberating surfaces.

Another object of this invention is to provide an acoustic screen, the number, location and angle of which can be easily changed to adjust or modulate an auditory effect.

Another object of this invention is to provide an acoustic screen assembling from a plurality of a sound absorbing and diffusing units, which can be easily moved or disassembled so as to modulate or adjust a sound-effect inside a room or a building.

Another object of this invention is to provide an ornamental sound absorbing perforated panel having a desired picture or pattern on each side thereof to be hung against a wall with an air chamber behind said panel or suspended below a ceiling whereby a sound-effect inside a room or a building can be easily adjusted or modulated.

Another object of this invention is to provide an ornamental sound absorbing perforated panel having a desired picture or pattern on each side thereof to be attached as an archtectual ornament on a wall or suspended below a ceiling whereby an interior appearance inside a room or surroundings can be readily changed.

Another object of this invention is to provide an ornamental sound absorbing and diffusing screen which can be easily moved to a desired place inside an acoustic room.

A further object of this invention resides in the easy and efficient method by which each unit is fabricated, in that, each unit may be readily joined together with each other or by a proper brace or a frame to form an acoustic screen.

A still further object of this invention is to provide a simple, practical and reliable construction that is economical to manufacture, easy to assemble and disassemble, and positive in its operation.

BRIEF DESCRIPTION OF DRAWINGS

These and other objects and advantages are obtained by the invention, which is described hereinbelow in connection with the accompanying drawings, wherein.

DESCRIPTION OF INVENTION IN RELATION TO DRAWINGS

Figure 1:
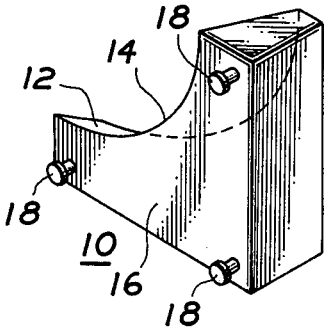
FIG. 1 is a rear perspective view of the first embodiment of the sound absorbing unit of this invention.
Figure 2:
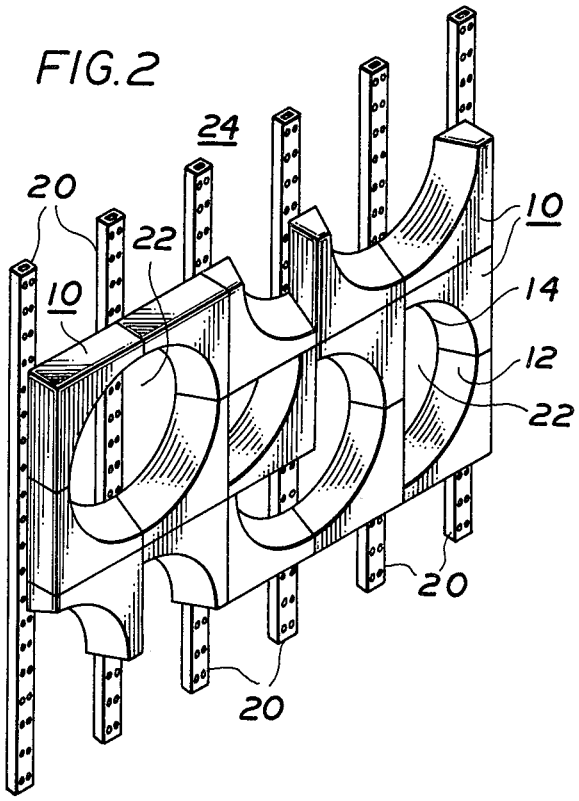
FIG. 2 is a partial perspective view of an acoustic screen assembling from a plurality of the sound absorbing units shown in FIG. 1.

Referring now to the accompanying drawings, and particularly to FIG. 1, there is shown the first embodiment of this invention. A sound absorbing and diffusing unit 10 made of porous sound absorbing material such as glass wool or rock wool is formed into a square having an arc-shaped portion 12, cut out at one corner, said arc-shaped portion is backwardly tapered to form a ridge 14 and a plurality of fittings 18 are provided on a back side 16 of said unit. In FIG. 2, these units 10 are detachably attached by the fittings 18 onto struts 20 which are mounted vertically in front of a wall in such a way that circular, semi-circular or quarter openings 22 may be formed to allow penetration of the sound and also to form an ornamental design, thus constituting a sound absorbing and diffusing screen 24. Alternately, lower ends of struts 20 may be stood upright on a self-supporting stand (not shown), which can be placed with a regular interval to and in front of the wall. The acoustic screen 10 can be easily placed or stood in front of a wall or attached thereto to achieve acoustical comfort.

Figure 3:
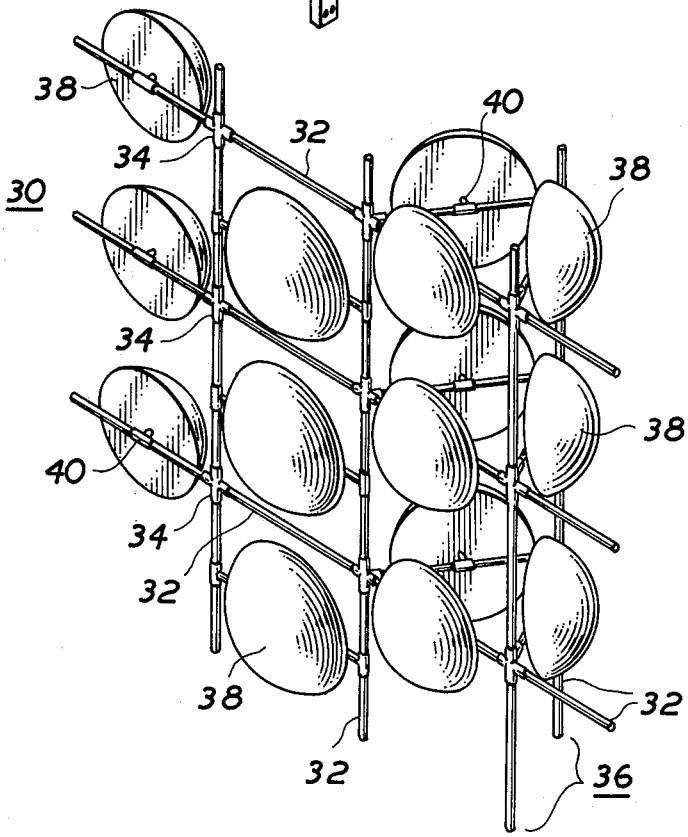
FIG. 3 is a partial rear perspective view of a modified form of the acoustic screen shown in FIG. 2.

As shown in FIG. 3, pipes 32 are vertically and horizontally combined by braces 34 to form a self-supporting framework 36 having square openings, and a plurality of sound absorbing and diffusing hemispheres 38 made of porous sound absorbing material are fixed to the pipes 32 by fittings 40 in such a manner that the hemispheres 38 occupy portions of the squares to form an acoustic screen 30, which can be arranged in front of the wall with an air chamber behind said screen.

Figure 4:
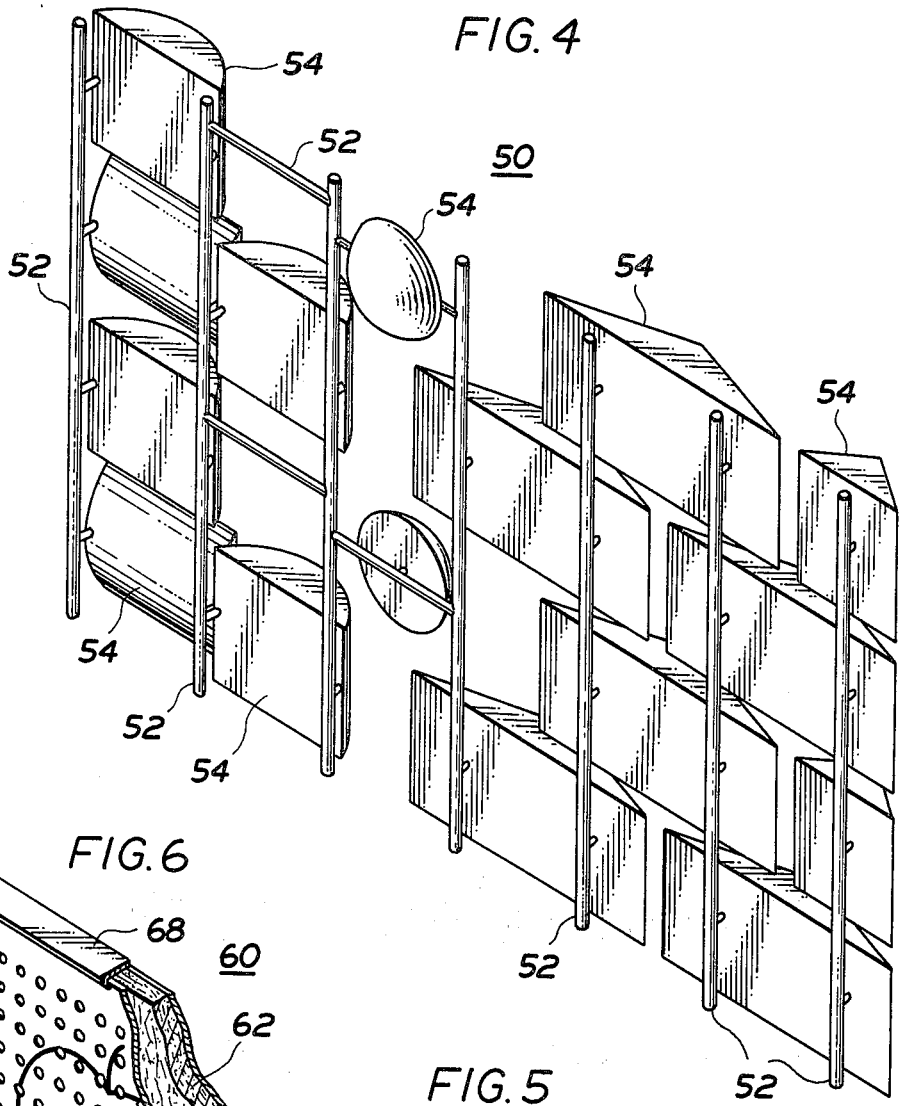
FIG. 4 is a similar rear perspective view of the further modification of the acoustic screen.

FIG. 4 shows another acoustic screen 50 consisting of a plurality of pipes 52 arranged parallely, vertically and combined with a number of various sound absorbing and diffusing units 54 such as semi-circular, hemispherical ones.

In the embodiments shown in FIGS. 1–4, various units made of sound absorbing and diffusing material having a suitable hardness are fixed to the strut, pipes or framings by fittings, coupling or sockets.

In case of using soft or low density sound absorbing material, it is possible to carry out a simultaneous molding by applying said soft material around the fittings or couplings. Alternately, the soft sound absorbing material can be filled into a porous shell or frame having mesh or grid openings and each surface is covered with a clothing to form a complicated construction exhibiting effective sound diffusion.

When a sound resonating shell is used together with a sound reverberating unit and also with lighting fixtures, more comfortable acoustic effect and interior ornamentation can be obtained.

Figure 6:
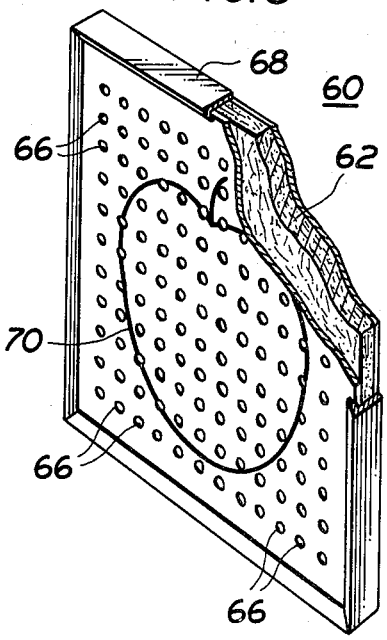
FIG. 6 is a perspective view, partly cut out, of the ornamental sound absorbing panel shown in FIG. 5.
Figure 5:
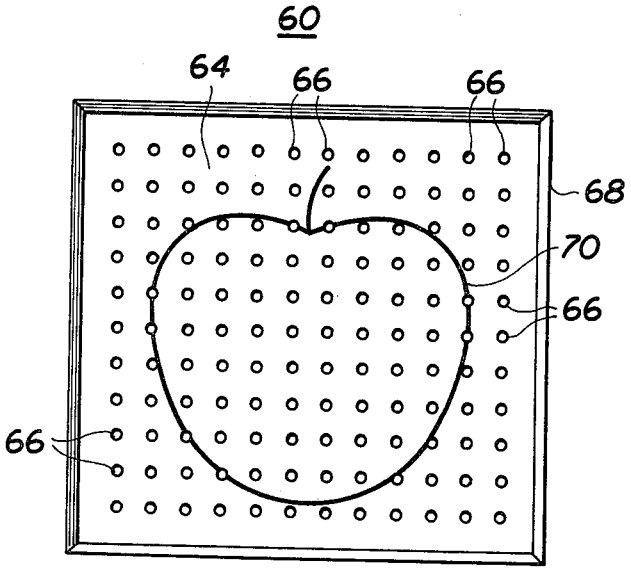
FIG. 5 is a schematic front elevation of an ornamental sound absorbing panel of this invention.

Referring to FIGS. 5 and 6, a layer of sound absorbing material 62 made of glass wool, rock wool or sponge having a regular thickness is integrally put between a pair of boards 64 and 64 having a number of small openings and surrounded by a frame 68 made of light metal such as aluminium so as to form a sound absorbing panel 60. A desired picture or pattern 70 is drawn on each face of these panels 64 and 64.

These decorative porous panels may be wood, plywood, plaster, cement boards or light metal such as aluminium board. Otherwise, these panels may be integrally covered with a proper clothing having a desired picture or pattern thereon.

These decorative sound absorbing panels 60 are hung against a wall by fittings with an air chamber behind, or the panels may be reversely hung to show another ornamentation.

As explained in the foregoing paragraphs, it can be seen that the number, location and angle of the sound absorbing and diffusing units of this invention can be easily changed by disassemnling the units and joining them again into another construction so that the sound absorbing and diffusing effects may be readily modulated or adjusted as desired. Consequently, it enables the adoping of a sound absorbing and diffusing unit having a given absorption coefficient and diffusion coefficient and also it is possible to use the sound absorbing and diffusing unit having any construction, size or material.

According to this invention, it facilitates the obtaining of a desired acoustically correct room by assembling the units into an acoustic screen, to modulate the acoustic effect by improving the assembly and by moving said screen into a desired place within the room and also to mount said screen by a fitting, brace, frame, arm, wire, etc.

Most of the incident sound penetrate through the screens 24, 30, 50 or the panels 60 and get lost in an air chamber therein or behind and the remaining sound reverberated off the wall is absorbed again when passing through these screens or panels, thus improving an acoustic effect and ornamentation.

While only a preferred embodiment of the present invention has been shown and described, other embodiments are contemplated and numerous changes and modifications may be made therein without departing from the spirit of the invention as set forth in the appended claims.

What is claimed is:

1. A sound absorbing and diffusing unit made of a porous sound absorbing material, said unit comprising two planar side surfaces, an arcuate surface opposed to said side surfaces, said arcuate surface being inclined with respect to said side surfaces, a rear surface formed between said side surfaces and said arcuate surface, and a plurality of fitting means fixed to said rear surface.

2. An acoustic sound screen formed from a plurality of sound absorbing and diffusing units as set forth in claim 1 comprising a plurality of struts wherein said fitting means are attached to said struts for mounting said units on said struts in a predetermined pattern.

* * * * *